US006279744B1

(12) United States Patent
Yu

(10) Patent No.: US 6,279,744 B1
(45) Date of Patent: Aug. 28, 2001

(54) TOOL KIT STRUCTURE

(76) Inventor: Chih-Hsin Yu, 4F-3, No. 123, Lane 235, Pao Chiao Rd., Hsin Tien City (TW)

( * ) Notice: Subject to any disclaimer, the term of this patent is extended or adjusted under 35 U.S.C. 154(b) by 0 days.

(21) Appl. No.: 09/558,854

(22) Filed: Apr. 27, 2000

(51) Int. Cl.[7] ..... B65D 85/28

(52) U.S. Cl. ..... 206/372; 220/505; 220/522; 220/529; 220/533

(58) Field of Search ..... 206/234, 315.11, 206/372, 373; 220/500, 503, 505, 521–523, 529, 533, 669, 670; 312/902

(56) References Cited

U.S. PATENT DOCUMENTS 4,884,689 * 12/1989 Su-Chin ..... 206/372
5,004,103 * 4/1991 Connors et al. ..... 206/372
5,472,110 * 12/1995 Boyd et al. ..... 206/373
5,601,206 * 2/1997 Haas et al. ..... 220/533

* cited by examiner

*Primary Examiner*—Jim Foster
(74) *Attorney, Agent, or Firm*—Bacon & Thomas PLLC

(57) ABSTRACT

A tool kit comprises a hollow case having a generally U-shaped storing space and a plurality of first spaced wave-shaped members provided on either opposing side, a hinged cover having a generally U-shaped section and second wave-shaped members formed as continuous ones with the corresponding first wave-shaped members when kit is closed, and a plurality of dividers removably provided between two opposed wave-shaped members. Such removeable adjustble dividers allow user to customize the division of storing space to suit the user's particular storing needs and access priorities. Further, an effective utilization of storing space is realized.

6 Claims, 5 Drawing Sheets

TOOL KIT STRUCTURE

FIELD OF THE INVENTION

The present invention relates to tool kit and more particularly to a compartmented tool kit structure.

BACKGROUND OF THE INVENTION

A conventional tool kit has a generally U-shaped section with a storing space therein for keeping tools, a U-shaped divider put on edges for dividing storing space into two smaller storing spaces, and a cover hinged to a side such that cover may close the tool kit when not in use. But this is unsatisfactory for the purpose for which the invention is concerned for the following reasons: 1. Such simple upper and lower storing spaces are not enough. It is often messy and thus time consuming in finding the desired tool. In brief, it does not allow user to customize the division of storing space to suit the user's particular storing needs and access priorities. 2. It is impossible to store a tool having a larger end in upper or lower storing space. That is, the U-shaped divider must be removed in order to leave the whole space for storing such a single tool, thereby neutralizing the U-shaped divider.

In view of the foregoing, the storing space of conventional tool kit does not perform well. Thus improvement exists.

SUMMARY OF THE INVENTION

It is an object of the present invention to provide an improved tool kit structure comprising two wave-shaped members on two opposed sides of storing space and a plurality of dividers removably provided between two opposed wave-shaped members. Such removeable adjustable dividers allow user to customize the division of storing space to suit the user's particular storing needs and access priorities. Thus a neat storing space is provided, resulting in an increase of the number of tools stored and a quick access. Moreover, a tool with a larger end may have the larger end penetrate through a hole of divider such that the other side of divider may still be employed to store other tools, thereby eliminating the conventional drawback of leaving the whole space for storing such a single large tool.

It is another object of the present invention to provide an improved tool kit structure wherein cover has two spaced cylindrical projections in the inner top surface and divider has two apertures corresponding and releasably secured to the cylindrical projections such that divider may not separate from cover when closing the tool kit. Further, divider may be provided between the wave-shaped members of cover when cover is opened, thereby forming a storing space in the cover.

The above and other objects, features and advantages of the present invention will become apparent from the following detailed description taken with the accompanying drawings.

DETAILED DESCRIPTION OF THE PREFERRED EMBODIMENTS

Figure 1:
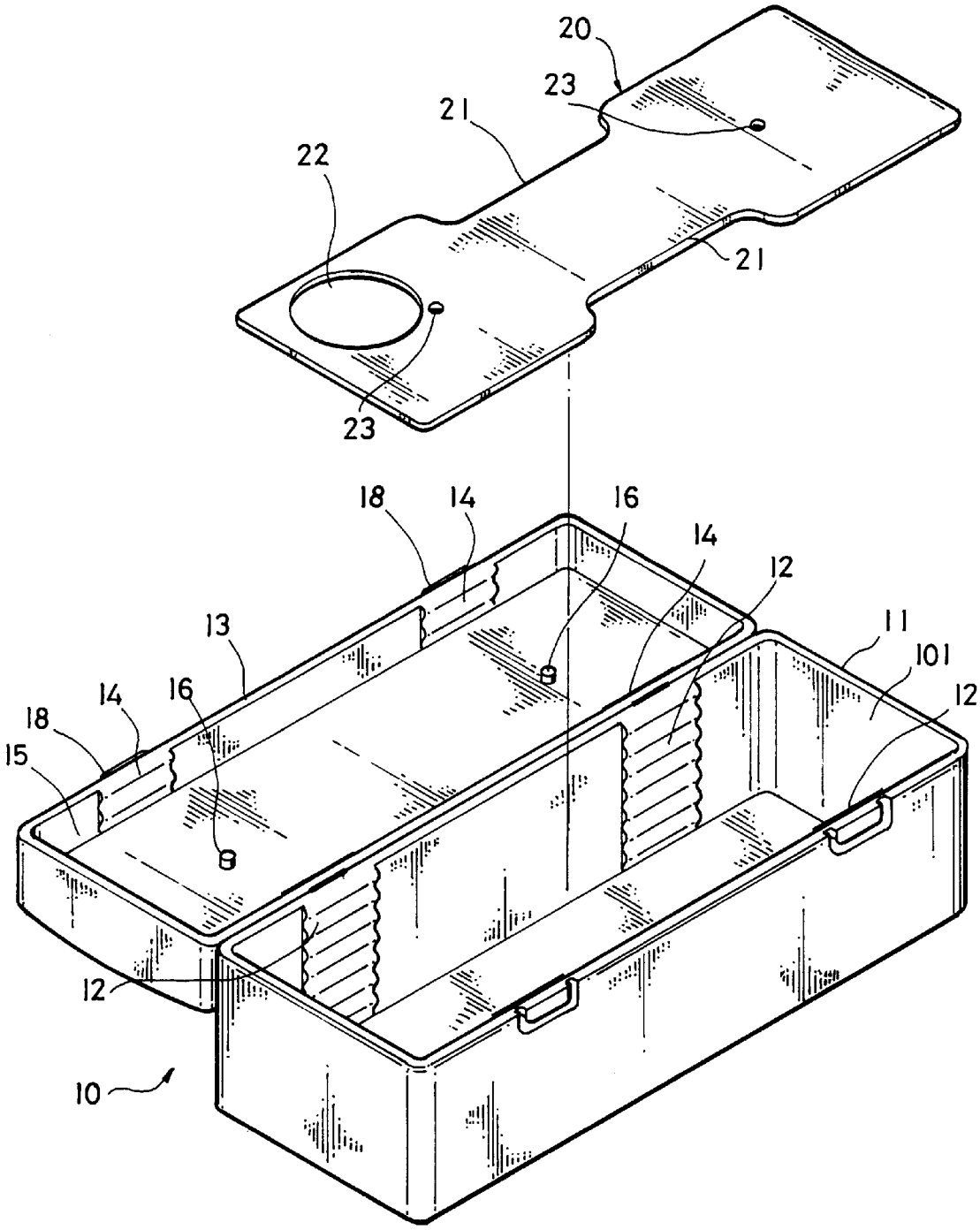
FIG. 1 is a perspective view of a first preferred embodiment of tool kit according to invention where cover open and divider separated.
Figure 2:
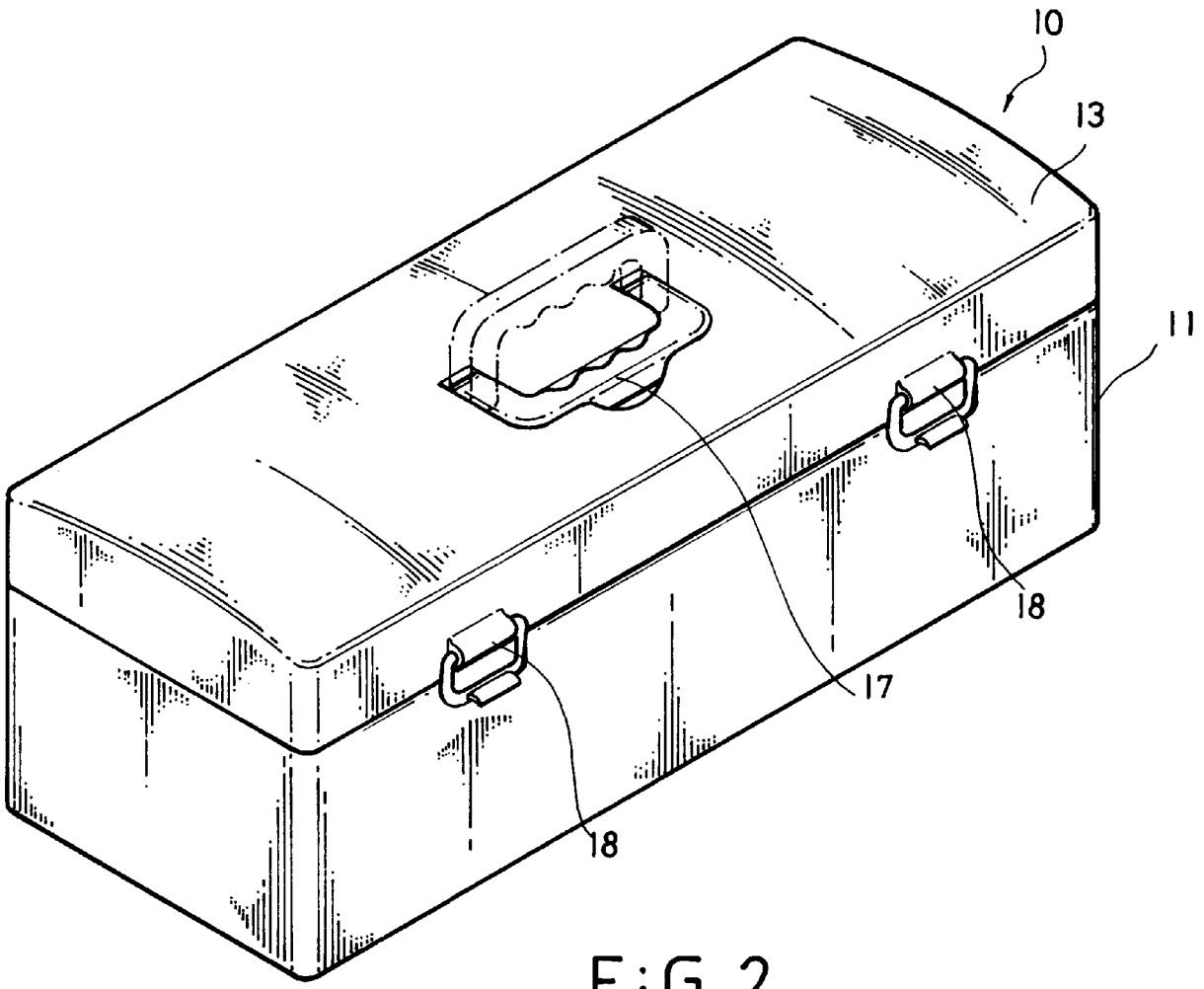
FIG. 2 is similar to FIG. 1 where cover closed.

Referring to FIGS. 1 to 4, there is shown a parallelepiped tool kit 10 constructed in accordance with the invention comprising a case 11 having a generally U-shaped section, a storing space 101 for keeping tools, at least two spaced wave-shaped members 12 vertically provided on either lengthwise side wherein the orientation of valley is parallel to the bottom surface of case 11 (FIG. 1), and a cover 13 hinged to a side also having a generally U-shaped section. Cover 13 may close the case 11 when not in use. Similarly, cover 13 has two spaced wave-shaped members 14 vertically provided on either lengthwise side wherein the orientation of valley is parallel to the inner top surface 15 of cover 13. One wave-shaped member 12 and the corresponding wave-shaped member 14 may form a single wave-shaped member when cover 13 is closed (FIGS. 1 and 2). Further, Two spaced cylindrical projections 16 are provided on the inner top surface 15 of cover 13. A handle 17 is provided on the outer top surface of cover 13. Handle 17 is normally held flush with the outer top surface of cover 13 when not in use. One or more fastening members such as clasps (e.g., two) 18 are provided on the side opposite to the hinge for securing the closed case 11.

Figure 3:
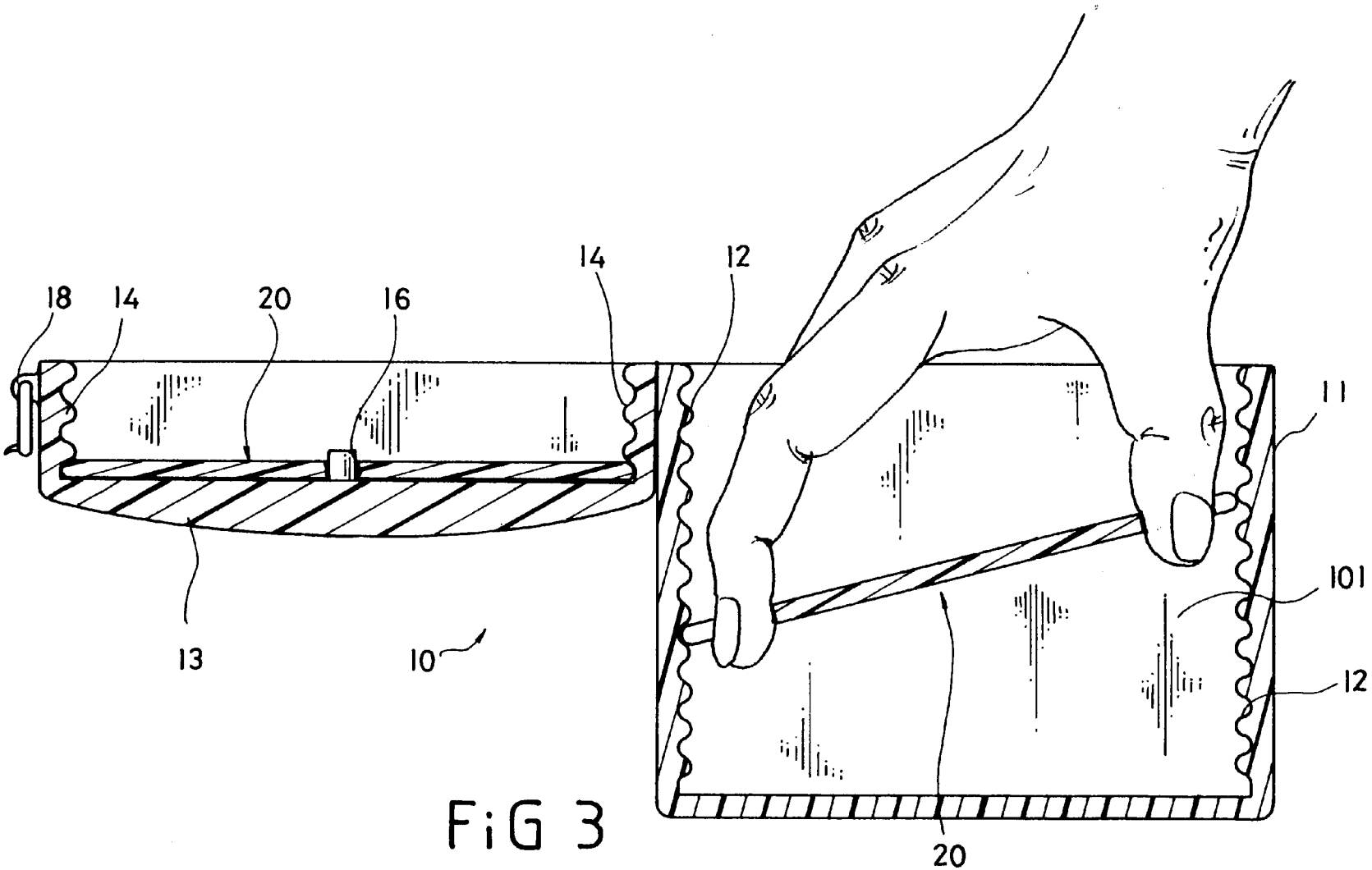
FIG. 3 is a sectional view of FIG. 1 illustrating how to employ a divider to adjust the storing space.
Figure 4:
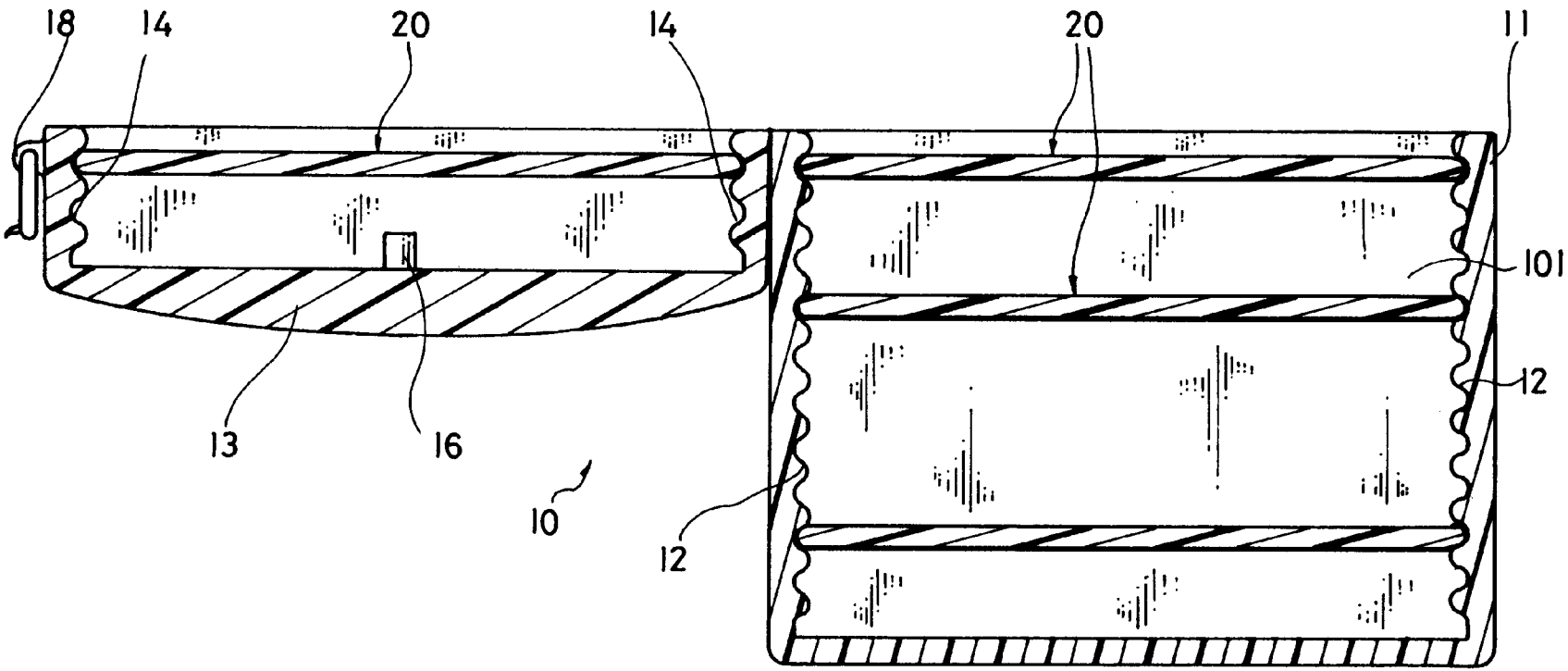
FIG. 4 is similar to FIG. 3 where a plurality of small storing spaces formed by four dividers.

A plurality of dividers 20 are removably provided between two opposed wave-shaped members 12 in the case 11 for customizing the division of storing space 101. User may easily hold the recesses 21 (FIG. 1) to put and secure divider 20 between opposed wave-shaped members 12 and 14 (FIG. 3). As shown, there are four compartments formed in the storing space 101 by dividers 20 (FIG. 4). Further, a hole 22 and two apertures 23 are provided on divider 20 (FIG. 1). These apertures 23 are corresponding and releasably secured to cylindrical projections 16 on the inner surface 15 of cover 13 (FIG. 3). With the provision of hole 22, a tool with a larger end may have the larger end penetrate through hole 22 such that the other side of divider 20 may be employed to store other tools without having to remove the divider 20. That is, both sides of divider 20 may store tools, resulting in an effective utilization of storing space 101. Further, with apertures 23 secured to cylindrical projection 16, divider 20 may not separate from cover 13 when closing the case 11. Furthermore, divider 20 may be provided between the wave-shaped members 14 of cover 13 when cover 13 is opened. That is, a storing space may be formed in the cover 13 by suitably adjusting the position of divider 20 with respect to wave-shaped members 14 (FIG. 4).

Figure 6:
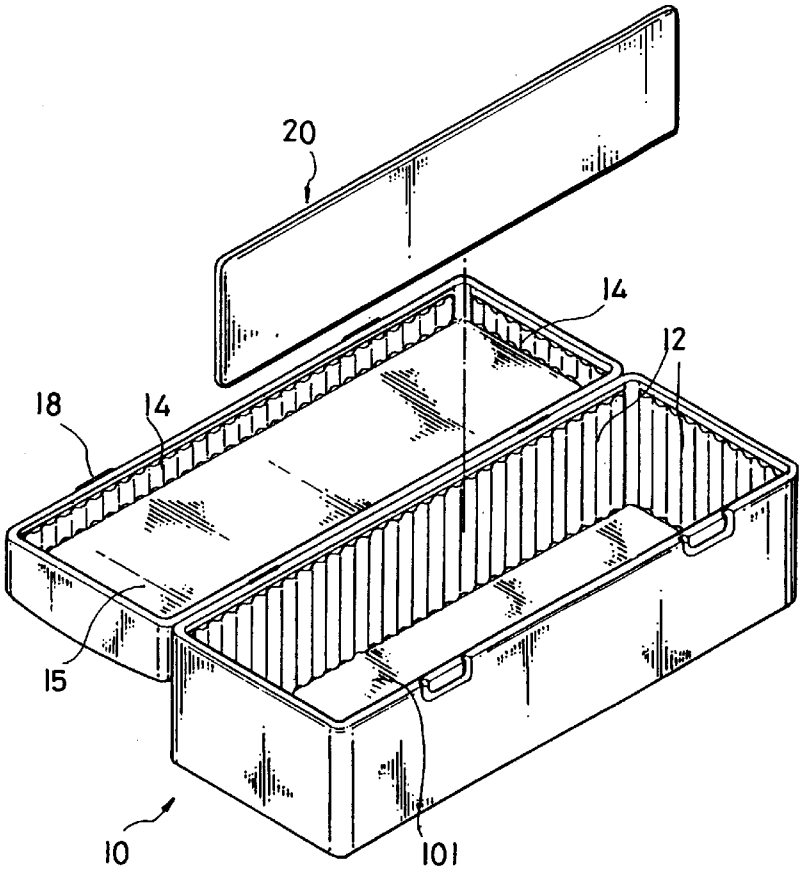
FIG. 6 is similar to FIG. 5 where a lengthwise divider separated.
Figure 5:
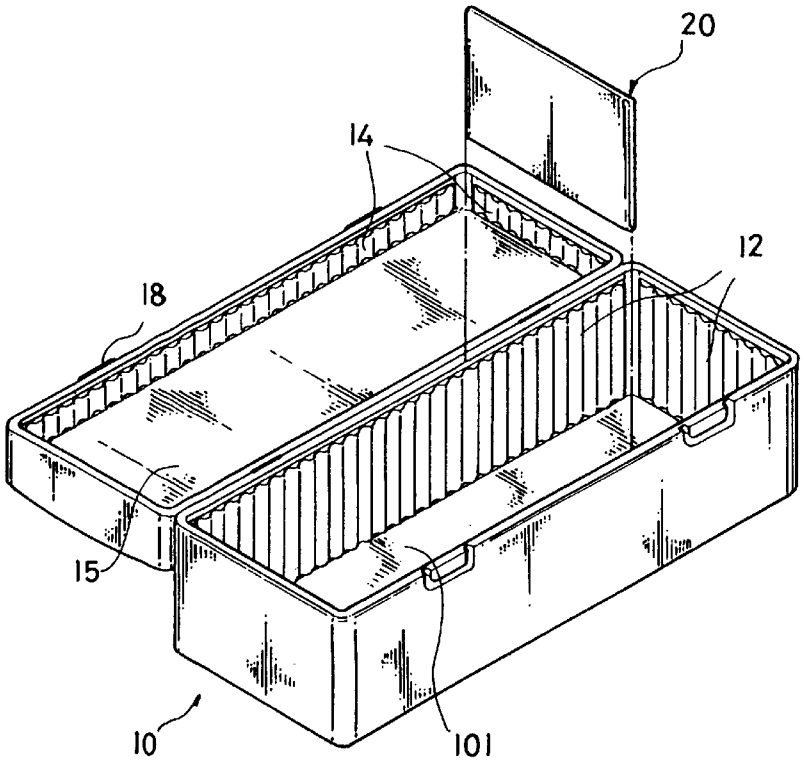
FIG. 5 is a perspective view of a second preferred embodiment of tool kit according to the invention where cover open and a widthwise divider separated.

Referring to FIGS. 5 and 6, there is shown a second embodiment of the invention. This embodiment differs from the first one in that a continuous wave-shaped members 12 fully occupies the four inner sides of tool kit 10 wherein the orientation of valley is perpendicular to the bottom surface of tool kit 10. Similarly, a continuous wave-shaped members 14 fully occupies the four inner sides of cover 13 wherein the orientation of valley is perpendicular to the inner top surface 15 of cover 14. With the provision of these wave-shaped members 12, a widthwise divider 20 may be provided between wave-shaped members 12 (FIG. 5) or a lengthwise divider 20 may be provided between wave-shaped members 12 (FIG. 6) for customizing the division of storing space 101. A similar division of the storing space of cover 13 is also possible.

The benefits of this invention are summarized as follows.

Such removeable adjustable dividers allow user to customize the division of storing space to suit the user's particular storing needs and access priorities. Thus a neat storing space is provided, resulting in an increase of the number of tools stored and a quick access.

A tool with a larger end may have the larger end penetrate through a hole of divider such that the other side of divider may still be employed to store other tools, thereby eliminating the conventional drawback of leaving the whole internal space of tool kit for storing such a single large tool.

While the invention herein disclosed has been described by means of specific embodiments, numerous modifications and variations could be made thereto by those skilled in the art without departing from the scope and spirit of the invention set forth in the claims.

What is claimed is:

1. A parallelepiped tool kit comprising:

a hollow case having a generally U-shaped storing space;

a plurality of spaced first wave-shaped members provided on either opposite side of the inside of the case;

a cover hinged to one side of the case having a generally U-shaped section;

a handle provided on the outer top surface of the cover;

one or more fastening members provided on the side of the tool kit opposite to the hinged side for securing the closed tool kit;

a plurality of spaced second wave-shaped members provided on either opposite side of the inside of the cover formed as continuous ones with the corresponding first wave-shaped members when the tool kit is closed; and a plurality of dividers removably provided between two opposed wave-shaped members for forming a plurality of first sub-storing spaces;

wherein the orientations of the valleys of the first and the second wave-shaped members are parallel to the bottom surface of the case.

2. The tool kit of claim 1, wherein the orientations of the valleys of the first and the second wave-shaped members are perpendicular to the bottom surface of the case.

3. The tool kit of claim 1, wherein the divider includes two recesses on two opposite sides and a hole.

4. The tool kit of claim 1, wherein the cover includes two spaced projections on the inner top surface of the cover.

5. The tool kit of claim 4, wherein the divider further includes two apertures corresponding and releasably secured to the projections such that divider does not separate from the cover when closing the tool kit and the divider is secured between the second wave-shaped members of the cover when the tool kit is opened, thereby forming a second sub-storing space in the cover.

6. The tool kit of claim 1, wherein the handle is capable of being held flush with the outer top surface of the cover when not in use.

* * * * *